US009506435B2

(12) United States Patent
Venkataraghavan et al.

(10) Patent No.: US 9,506,435 B2
(45) Date of Patent: Nov. 29, 2016

(54) SOLENOID ACTUATOR AND FUEL INJECTOR USING SAME

(71) Applicant: Caterpillar Inc., Peoria, IL (US)

(72) Inventors: Jayaraman Venkataraghavan, Dunlap, IL (US); John McDonnell, DeWitt, IA (US); Nadeem Bunni, Cranberry Township, PA (US); Christopher D. Hanson, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 184 days.

(21) Appl. No.: 14/220,748

(22) Filed: Mar. 20, 2014

(65) Prior Publication Data

US 2014/0203113 A1 Jul. 24, 2014

Related U.S. Application Data

(62) Division of application No. 12/972,869, filed on Dec. 20, 2010, now Pat. No. 8,729,995.

(51) Int. Cl.

| | |
|---|---|
| ***F02M 51/06*** | (2006.01) |
| ***F02M 47/02*** | (2006.01) |
| ***F02M 63/00*** | (2006.01) |
| ***H01F 7/16*** | (2006.01) |

(52) U.S. Cl.

CPC ..... *F02M 51/0625* (2013.01); *F02M 47/027* (2013.01); *F02M 51/061* (2013.01); *F02M 51/0635* (2013.01); *F02M 63/0015* (2013.01); *H01F 7/1638* (2013.01); *F02M 63/0075* (2013.01)

(58) Field of Classification Search

CPC ..... F02M 47/027; F02M 51/061; F02M 51/0614; F02M 51/0635–51/066; F02M 63/0015–63/0022; F02M 63/0075; F02M 51/0625; H01F 7/1638

USPC ..... 239/96, 585.1–585.5

See application file for complete search history.

(56) References Cited

U.S. PATENT DOCUMENTS

| | | | | |
|---|---|---|---|---|
| 4,509,693 | A | 4/1985 | Nakai | |
| 4,552,311 | A | 11/1985 | Casey | |
| 5,054,691 | A | 10/1991 | Huang et al. | |
| 5,125,575 | A * | 6/1992 | Iwanaga | F02M 47/027 239/585.3 |
| 5,207,205 | A | 5/1993 | Mesenich | |
| 5,927,614 | A | 7/1999 | Touvelle et al. | |

(Continued)

*Primary Examiner* — Arthur O Hall
*Assistant Examiner* — Cody Lieuwen

(57) ABSTRACT

In one aspect, a fuel injector includes an injector body that defines a fuel inlet, a drain outlet and a nozzle outlet. A direct operated check valve is positioned in the injector body and includes a needle valve member with an opening hydraulic surface exposed to fluid pressure in a nozzle supply passage, and a closing hydraulic surface exposed to fluid pressure in a needle control chamber. The needle valve member is movable between a first position at which the nozzle supply passage is blocked to the nozzle outlet, and a second position at which the nozzle supply passage is open to the nozzle outlet. A needle control valve is positioned in the injector body and includes a control valve member movable between a first position at which the needle control chamber is fluidly connected to the drain outlet, and a second position at which the needle control chamber is fluidly blocked to the drain outlet. A solenoid actuator is positioned in the injector body and includes a stator assembly and an armature assembly coupled to the control valve member. One of the stator assembly and the armature assembly includes a non-magnetic insert that moves into and out of contact with another of the stator assembly and the armature assembly at an energized position and a de-energized position, respectively.

14 Claims, 4 Drawing Sheets

(56) References Cited

U.S. PATENT DOCUMENTS 7,028,928 B2 * 4/2006 Shinogle ..... F02M 57/025 239/533.11
2002/0096581 A1 * 7/2002 Ricco ..... F02M 47/027 239/585.1
2006/0226252 A1 * 10/2006 Kubo ..... F02M 47/027 239/88
2007/0057218 A1 * 3/2007 Kuno ..... F02M 51/0646 251/129.21
2009/0242667 A1 * 10/2009 Pusch ..... F02M 61/166 239/533.2
2010/0012754 A1 1/2010 Hayatani et al.
2010/0162992 A1 * 7/2010 Ricco ..... F02M 47/027 123/299

* cited by examiner

SOLENOID ACTUATOR AND FUEL INJECTOR USING SAME

CROSS-REFERENCE TO RELATED APPLICATIONS

This patent application is a divisional of U.S. patent application Ser. No. 12/972,869, filed Dec. 20, 2010.

TECHNICAL FIELD

The present disclosure relates generally to high speed solenoid actuators, and more particularly to a structure for a stator assembly and armature assembly of a solenoid of a fuel injector.

BACKGROUND

Common rail fuel systems have shown considerable promise in providing the versatility necessary to improve performance while also reducing undesirable emissions, especially in relation to compression ignition engines. As the industry demands ever more performance capabilities at a wide variety of engine operating conditions, new problems have arisen. For instance, in order to produce the lowest possible emissions during a combustion event, fuel injectors are often called upon to have the ability in inject relatively large volumes and extremely small volumes of fuel, sometimes in the same sequence involving a main injection event followed closely by a closed coupled post injection event. Being able to accurately inject different volumes of fuel in a broad range at precise timings using a fuel injector in a limited spatial envelope may require great attention to materials utilized and structures associated with the solenoid assembly used to control injection events. In addition, these assemblies must be robust and consistent in the hostile environment of an internal combustion engine.

One example fuel injector is described in co-owned U.S. Patent Publication 2010/0176223, which shows a common rail fuel injector that utilizes a direct operated check valve that is controlled by a two-way needle control valve. The needle control valve opens and closes a needle control chamber to a low pressure passageway connected to a drain outlet by energizing and de-energizing, respectively, a solenoid actuator. Among other things, this reference demonstrates that many variables must be considered and a host of choices made in order to arrive at a solenoid assembly recipe that meets all of the performance, life expectancy, consistency and other specifications associated with a real combination of hardware that can perform as expected in a real internal combustion engine, and be manufacturable in mass quantities at a competitive cost.

The present disclosure is directed toward one or more of the problems set forth above.

SUMMARY OF THE DISCLOSURE

In one aspect, a solenoid includes a stator assembly with a housing that includes a top piece and defines a pin bore. A fragile highly magnetic core extends between a top end and an armature end. A coil winding is positioned around the fragile highly magnetic core. A centerpiece extends completely through the fragile highly magnetic core with one end received in the pin bore, and an opposite end including a core shield covering the armature end of the fragile highly magnetic core. The core shield includes an armature stop. The stator assembly also includes a flux ring. An armature assembly includes an armature attached to move with a pin within the flux ring, but being separated from the flux ring by a sliding air gap. The pin and armature are movable between an energized position and a de-energized position. One of the stator assembly and the armature assembly include a non-magnetic insert that moves into and out of contact with an other of the stator assembly and the armature assembly at the energized position and the de-energized position, respectively.

In another aspect, a fuel injector includes an injector body that defines a fuel inlet, a drain outlet and a nozzle outlet. A direct operated check valve is positioned in the injector body and includes a needle valve member with an opening hydraulic surface exposed to fluid pressure in a nozzle supply passage, and a closing hydraulic surface exposed to fluid pressure in a needle control chamber. The needle valve member is movable between a first position at which the nozzle supply passage is blocked into the nozzle outlet, and a second position at which the nozzle supply passage is open to the nozzle outlet. A needle control valve is positioned in the injector body, and includes a control valve member movable between a first position at which the needle control chamber is fluidly connected to the drain outlet, and a second position at which the needle control chamber is fluidly blocked to the drain outlet. A solenoid actuator is positioned in the injector body and includes a stator assembly and an armature assembly coupled to the control valve member. One of the stator assembly and the armature assembly includes a non-magnetic insert that moves into and out of contact with an other of the stator assembly and the armature assembly at an energized position and a de-energized position, respectively.

In still another aspect, a method of operating a fuel injector includes initiating an injection event by energizing a solenoid, and ending the injection event by de-energizing the solenoid. A non-magnetic insert of one of the stator assembly and the armature assembly contacts an other of the stator assembly and the armature assembly responsive to energizing the solenoid. The non-magnetic insert is moved out of contact with the other of the stator assembly and the armature assembly responsive to de-energizing the solenoid. A control valve member is moved toward a position that fluidly connects a needle control chamber to a drain outlet responsive to energizing the solenoid. Pressure on a closing hydraulic surface of a needle valve member, which is exposed to fluid pressure in the needle control chamber, is relieved responsive to moving the control valve member. The needle valve member is moved from a position that blocks the nozzle outlet to a position that fluidly connects a nozzle supply passage to the nozzle outlet responsive to exposing an opening hydraulic surface of the needle valve member to a fluid pressure in a nozzle supply passage and responsive to the relieving pressure on the closing hydraulic surface.

DETAILED DESCRIPTION

Figure 1:
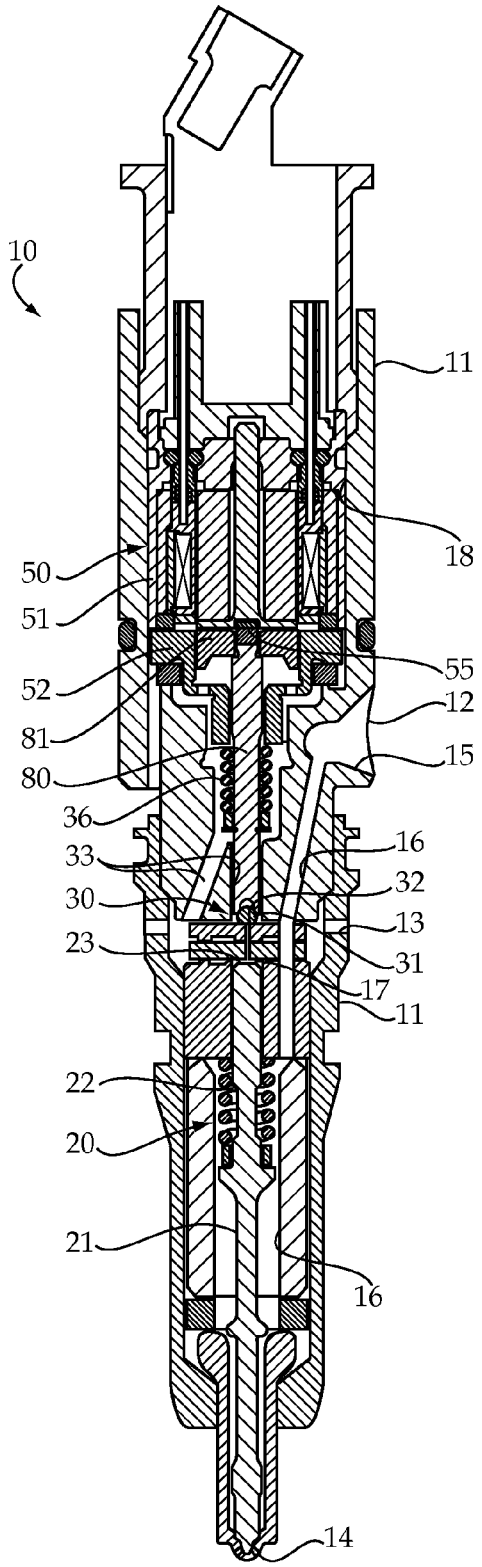
FIG. 1 is a sectioned side diagrammatic view of a fuel injector according to one aspect of the present disclosure.
Figure 2:
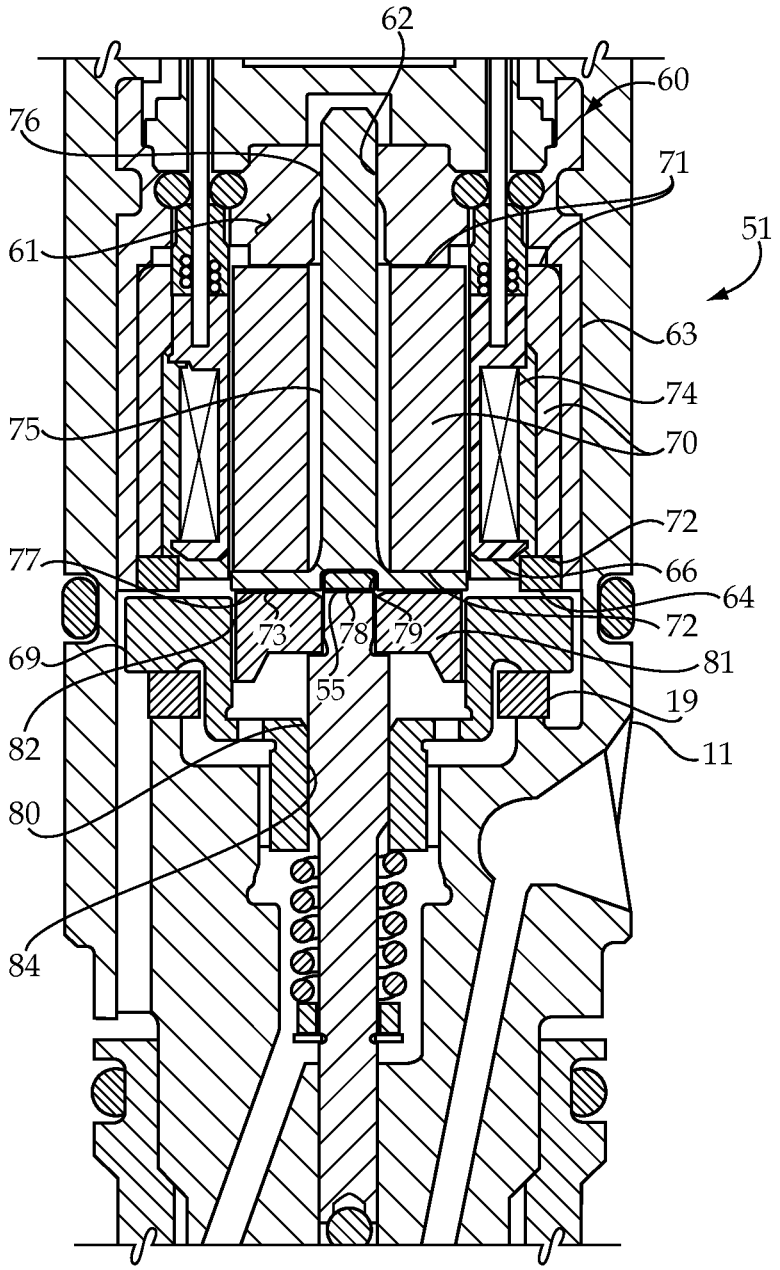
FIG. 2 is an enlarged sectioned side view of a solenoid actuator from the fuel injector of FIG. 1.

Referring to FIGS. 1 and 2, a fuel injector 10 includes a solenoid actuator 50 housed in an injector body 11 that defines a fuel inlet 12, a drain outlet 13 and a nozzle outlet 14. In the illustrated embodiment, fuel injector 10 is a common rail fuel injector, which is evidenced by the inclusion of a conical seat 15 at fuel inlet 12 for receiving a quill (not shown) to transfer high pressure fuel from a common rail (not shown). Nevertheless, other fuel injectors (e.g., cam actuated) might also fall within the scope of the present disclosure. Fuel injector 10 includes a direct operated check valve 20 that is positioned in injector body 11, and includes a needle valve member 21 with an opening hydraulic surface 22 exposed to fluid pressure in a nozzle supply passage 16, which is fluidly connected to fuel inlet 12. In addition, needle valve member 21 includes a closing hydraulic surface 23 exposed to fluid pressure in a needle control chamber 17. The needle valve member 21 is movable between a first position (as shown) at which the nozzle supply passage 16 is blocked to nozzle outlet 14, and a second position at which nozzle supply passage 16 is open to nozzle outlet 14 for an injection event. A needle control valve 30 is positioned in injector body 11 and includes a control valve member 31. The solenoid actuator 50 includes a stator assembly 51 and an armature assembly 52 coupled to move the control valve member 31. The control valve member 31 is movable between a first position at which the needle control chamber 17 is fluidly connected to the drain outlet 13, and a second position at which the needle control chamber 17 is fluidly blocked to the drain outlet 13. In the fuel injector of FIGS. 1 and 2, the needle valve member 31 is biased into contact with a flat seat 32 via a spring 36 that pushes on control valve member 31 via a pin 80. When solenoid actuator 50 is energized, control valve member 31 lifts off of flat seat 32 to fluidly connect needle control chamber 17 to drain outlet 13 via low pressure passage(s) 33.

Figure 3:
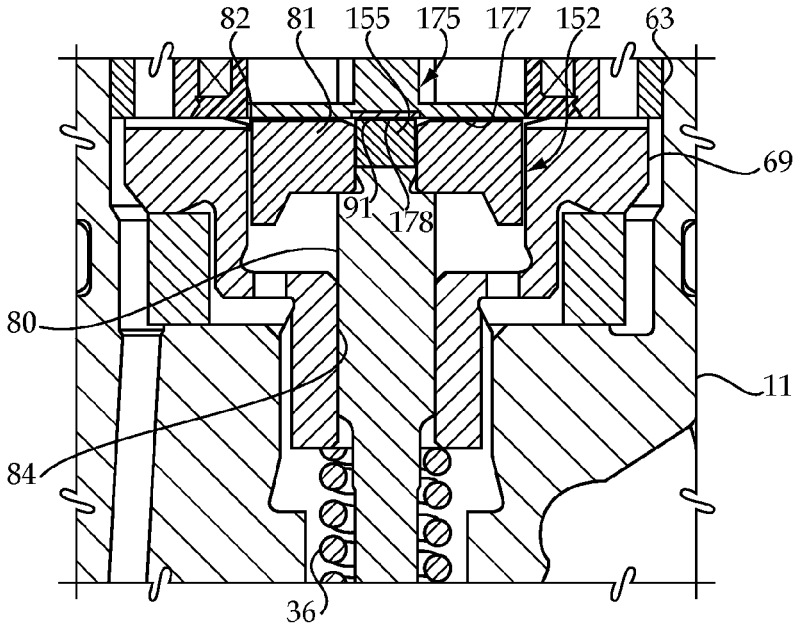
FIG. 3 is an enlarged sectioned side diagrammatic view of an armature assembly according to another aspect of the disclosure.

In all fuel injectors according to the present disclosure, one of the stator assembly 51 and the armature assembly 52 include a non-magnetic insert 55 that moves into and out of contact with an other of the stator assembly 51 and armature assembly 52 at an energized positioned and a de-energized position, respectively. In the embodiments of FIGS. 1 and 2, non-magnetic insert 55 is a portion of the stator assembly 51. The embodiment of FIG. 3 shows a non-magnetic insert 155 that is a portion of an armature assembly 152. In the context of the present disclosure, the term "non-magnetic insert" means an identifiable separate component made from a material that exhibits a magnetic flux density that is less than Ø.5 Tesla at a field strength of 10000 (amperes/meter). For example, a metallic non-magnetic insert might be made from tungsten carbide, and a non-metallic insert might be made from ceramic. Certain stainless steel alloys might also be considered for non-magnetic inserts according to the present disclosure. When installed in a solenoid actuator 50 according to the present disclosure, non-magnetic insert 55 is always a portion of an armature stop or contacts the armature stop, when the solenoid actuator 50 is energized. Thus, a non-magnetic insert 55 according to the present disclosure always has a contact surface. When the stator assembly 51 and armature assembly 52 are in contact with one another at the non-magnetic insert, a final air gap is maintained between the stator assembly and the top surface of the armature in a typical manner.

Stator assembly 51 includes a housing 60 (FIG. 2) that includes a top piece 61 that defines a pin bore 62. As seen in FIG. 1, housing 60 is positioned in a hollow segment 18 of injector body 11 at the time of manufacture. A fragile highly magnetic core 70 extends between a top end 71 and an armature end 72, which appears twice in FIG. 2 to refer to a central portion and a radial outer portion. Fragile highly magnetic core 70 may be constructed from a suitable fragile but highly magnetic material, such as Somoloy or the like that have little ability to support typical clamping loads associated with fuel injectors, but have superior flux carrying capabilities not currently available in more structural metallic alloys, such as those used to construct housing 60. When installed in fuel injector 10, housing 60 may serve to channel the compressive clamping loads of fuel injector 10 around the fragile highly magnetic core 72 protect the core from breakage. A coil winding 74 is supported by a bobbin 66 and positioned around the fragile highly magnetic core 70. A centerpiece 75 extends completely through the fragile highly magnetic core 70 with one end 76 received in the pin bore 62, and an opposite end 73 that includes a core shield 77 covering a central portion of the armature end 72 of the fragile highly magnetic core 70. The core shield 77 includes an armature stop 78. A bottom piece ring 64 protects the radial outer portion of the armature end 72 of fragile highly magnetic core 72. Stator assembly 51 also includes a flux ring 69 that may be supported on an injector stack component 19 and include a portion that defines a guide bore 84. Flux ring 69 may be compressed between housing 60 and a portion of the injector body 11. In the embodiment of FIGS. 1 and 2, non-magnetic insert 55 is mounted in an insert cavity 79 defined by centerpiece 75. Although not absolutely necessary, the fragile highly magnetic core 70 may be enclosed in housing 60 and the core shield 77. In the embodiment of FIGS. 1 and 2, housing 60 includes top piece 61, and hollow cylinder 63, that may or may not be a portion of the same component of top piece 61, and a bottom piece 64. Nevertheless, those skilled in the art will appreciate that housing 60 could be composed of multiple components without departing from the present disclosure.

The armature assembly 52 includes the pin 80 that is attached to move with an armature 81 between an energized position where pin 80 contacts armature stop 78, and a de-energized position at which pin 80 is out of contact with armature stop 78. Throughout this motion, armature 81 always maintains an air gap with respect to the stator assembly 51 in general, and the core shield 77 in particular with respect to the disclosed embodiment. In the illustrated embodiment, the armature 81 is separated from the flux ring 69 by a sliding air gap 82. Nevertheless, those skilled in the art will appreciate that solenoids that include no sliding air gap might also fall within the present disclosure. Pin 80 may be attached to armature 81 in any suitable manner, such as by a press fit.

Referring to FIG. 3, an alternative embodiment of the present disclosure locates the non-magnetic insert 155 as a portion of the armature assembly 152 rather than as a portion of the stator assembly 51 as in the embodiments of FIGS. 1 and 2. The embodiment of FIG. 3 also differs from that of FIGS. 1 and 2 by the inclusion of a centerpiece 175 that is composed of a single material that is homogenous except for a central hardened layer 91 that is the armature stop 178. The central hardened layer has lower magnetic properties but is hardened relative to a remaining portion 92 of the centerpiece 175. Thus, the remaining portion 92 may be a relative soft magnetic material, but the central hardened layer 91 occupies a minority of a volume of the centerpiece 175. In the embodiment of FIG. 3, the non-magnetic insert 155, the pin 80 and the armature 81 move as a unit between a de-energized position at which the non-magnetic insert 155 is out of contact with the central hardened layer 91 (armature stop 178), and an energized position at which the non-magnetic insert 155 is in contact with armature stop 178. Non-magnetic insert 155 may be attached in any suitable manner, such as via a press fit into armature 81. Like the earlier embodiment, the armature 81 maintains a sliding air gap with flux ring 69, and maintains an air gap at all positions with respect to the stator assembly 51 in general, and the core shield 177 in particular.

Figure 4:
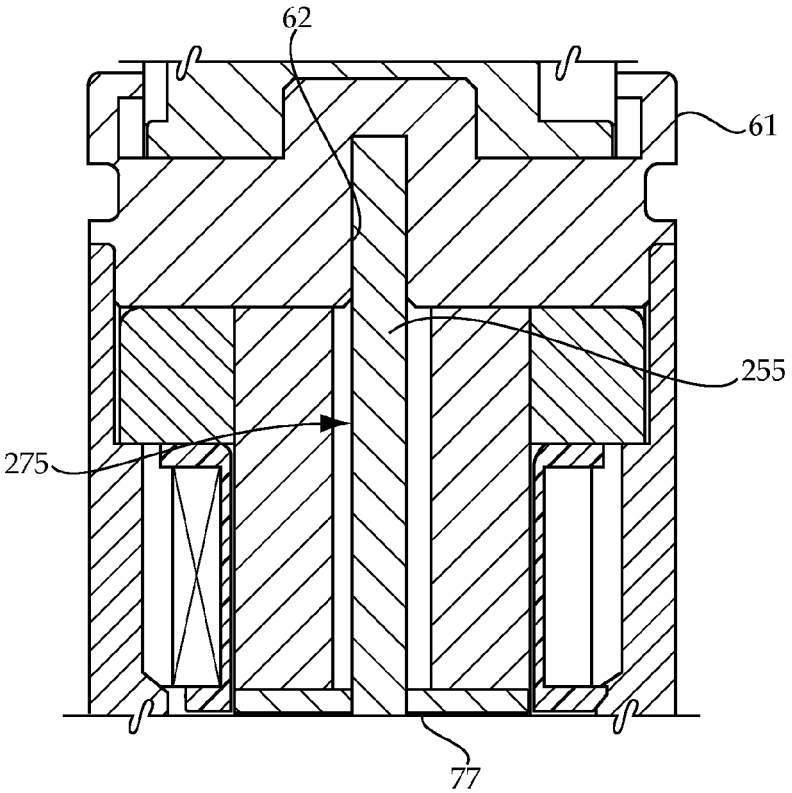
FIG. 4 is a side sectioned view of a stator assembly according to another aspect of the present disclosure.

FIG. 4 shows still another embodiment in which the non-magnetic insert 255 is relatively larger than the earlier embodiments and takes the form of a pin. One end of the non-magnetic insert 255 is received in pin bore 62 of top piece 61, with the other end extending through but attached to the core shield 177. Like the earlier embodiments, together non-magnetic insert 255 and core shield 177 constitute a centerpiece 275 according to the present disclosure. Although the embodiment of FIG. 4 may present a more durable and robust strategy for the present disclosure, it sacrifices with regard to the flux carrying capacity of the centerpiece 275, which can substantially contribute to the performance characteristics (e.g., speed) of the solenoid actuator. Although the embodiments of FIGS. 1 and 3 may appear somewhat equivalent, testing suggests that the embodiment of FIGS. 1 and 2 edges out the performance associated with the embodiment of FIG. 3.

Figure 5:
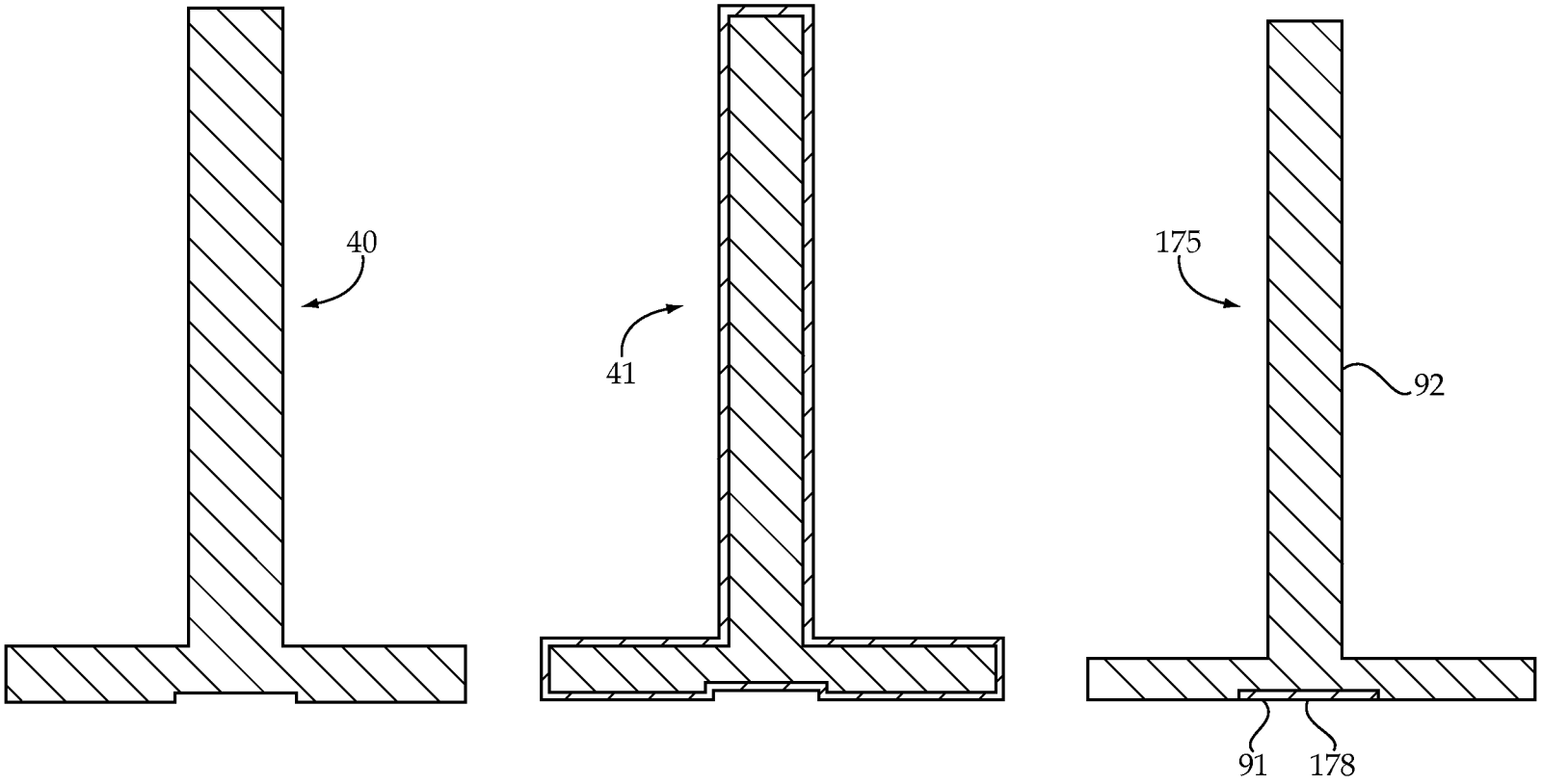
FIG. 5 is a series of views showing a manufacturing strategy for a centerpiece for a stator assembly according to another aspect of the present disclosure.

Referring now to FIG. 5, a series of steps are shown for one strategy of constructing the centerpiece 175 that is associated with the embodiment of FIG. 3. As stated earlier, the centerpiece 175 is composed of a single homogenous magnetic material that is generally relatively soft, but includes a central hardened layer 91 that acts as an armature stop 178. One strategy for making centerpiece 175 is to begin with a homogenous oversized base piece 40. This piece may then be converted into a case hardened piece 41 with oversized dimensions similar to that of the base piece 40 via known techniques, such as by carburizing the base piece 40 to produce a hardened layer that may be on the order of about half a millimeter thick. Next, the oversized case hardened piece 41 may be machined to remove the hardened layer at all surfaces except leaving a lower magnetic hardened layer 91 at the central location to function as the armature stop 178. The central hardened layer 91 may have a hardness on the order of about 56 RWC. Other strategies for making the central hardened layer on a homogenous piece of relatively soft magnetic material might also include a laser hardening process, or a strategy associated with induction hardening at the armature stop location using known induction hardening techniques. Other strategies for maintaining the centerpiece as a flux carrier that is relatively soft to include a hardened layer at armature stop 178 would also fall within the intended scope of the present disclosure.

INDUSTRIAL APPLICABILITY

The present disclosure finds general applicability in any solenoid actuator, but is specifically applicable to high speed solenoid actuators often associated with engine components such as fuel injectors and pumps. The solenoid actuator of the present disclosure finds specific applicability in common rail fuel injectors for compression ignition engines, but could also find potential application in cam actuated fuel injectors, or maybe even direct control fuel injectors of the type associated with gasoline spark ignited engines. The solenoid actuator of the present disclosure finds specific applicability in common rail fuel injectors having broad performance requirements that include the ability to inject extremely small amounts of fuel, such as those associated with close coupled post injection that follow quickly after a relatively large main injection event.

Fuel injector 10 is operated by energizing solenoid actuator 50 to initiate an injection event. The solenoid actuator 50 is then de-energized to end an injection event. When the solenoid actuator 50 is energized, the armature assembly 52 moves toward the stator assembly until the non-magnetic insert 55 makes contact with the pin 80 of the armature assembly 52. In the case of the embodiment of FIG. 3, the non-magnetic insert 155 of the armature assembly makes contact with the central hardened layer 91 that is the armature stop 178 of the center piece 175 of the stator assembly. When the solenoid is de-energized, the non-magnetic insert moves out of contact with one of the armature assembly (FIGS. 1, 2 and 4) and the stator assembly (FIG. 3) responsive to the solenoid actuator 50 being de-energized. Control valve member 31 is moved toward a position that fluidly connects the needle control chamber 17 to the drain outlet 13 responsive to the solenoid actuator 50 being energized. When this occurs, pressure on the closing hydraulic surface 23 of the needle valve member 21 is relieved responsive to movement of the control valve member 31. When this occurs, the needle valve member 21 moves from a position that blocks the nozzle outlets 14 to a position that fluidly connects the nozzle supply passage 16 to the nozzle outlet 14 responsive to pressure on closing hydraulic surface 23 being relieved. This allows the needle valve member to be lifted by the pressure force acting on opening hydraulic surface 22 that is exposed to fluid pressure in the nozzle supply passage 16. During movement of the armature assembly 52, a sliding air gap 82 is maintained between the armature 81 and the flux ring 69 of the stator assembly 51. The present disclosure also contemplates protection of the fragile highly magnetic core 70 from breakage by enclosing the fragile highly magnetic core 70 in the housing 60 (top piece 61, hollow cylinder 63 and bottom piece 64) and core shield 77.

By including a non-magnetic insert at the location where the armature assembly contacts the stator assembly when the solenoid actuator 50 is energized, the pin 80 is magnetically isolated and a build up of residual magnetism in pin 80 can be reduced or avoided. In other words, magnetic flux is diverted from the top portion of pin 80 to the armature 81, by reducing flux in non-magnetic insert 55, 155. Those skilled in the art will appreciate that if the pin 80 becomes overly magnetized, performance of the solenoid actuator in particular, and the fuel injector 10 in general, could be compromised especially when being commanded to produce a small injection quantity after a short dwell following a main injection event. Residual magnetism in the pin could cause the pin to linger briefly near the energized position even after the solenoid actuator becomes de-energized. As such, the performance speed of the armature assembly 52 in moving back toward its de-energized position might be made slower with the presence of residual magnetism in pin 80. However, the non-magnetic insert of the present disclosure may prevent or substantially reduce the build up of residual magnetism in pin 80 and improve performance over a counterpart equivalent fuel injector that was otherwise identical except not including a non-magnetic insert of the present disclosure. Thus, the inclusion of the non-magnetic insert of the present disclosure provides for an incremental improvement especially in better enabling small post injection fuel quantities following a main injection event, which is often a performance characteristic desired in today's fuel injection systems.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body defining a fuel inlet, a drain outlet and a nozzle outlet;

a direct operated check valve positioned in the injector body and including a needle valve member with an opening hydraulic surface exposed to fluid pressure in a nozzle supply passage, and a closing hydraulic surface exposed to fluid pressure in a needle control chamber, and the needle valve member being movable between a first position at which the nozzle supply passage is blocked to the nozzle outlet, and a second position at which the nozzle supply passage is open to the nozzle outlet;

a needle control valve positioned in the injector body and including a control valve member movable between a first position at which the needle control chamber is fluidly connected to the drain outlet, and a second position at which the needle control chamber is fluidly blocked to the drain outlet; and a solenoid actuator positioned in the injector body and including a stator assembly and an armature assembly coupled to the control valve member, the stator assembly including a top piece that defines a pin bore, a fragile highly magnetic core extending between a top end adjacent the top piece and an armature end, a centerpiece extending completely through the fragile highly magnetic core and having a first end received in the pin bore and a second end defining a core shield disposed between the fragile highly magnetic core and the armature assembly, and a nonmagnetic insert attached to the centerpiece and configured to contact the armature assembly when the solenoid actuator is in an energized state and to be out of contact with the armature assembly when the solenoid actuator is in a de-energized state, wherein the core shield defines an insert cavity and the non-magnetic insert is mounted in the insert cavity.

2. The fuel injector of claim 1 wherein:

the stator assembly further includes a coil winding positioned around the fragile highly magnetic core, an armature stop included in the core shield, and a flux ring defining a guide bore; and the armature assembly further includes a pin in guide contact with the guide bore, and being movable between an energized position, being defined when the solenoid is in an energized state, and a de-energized position, being defined when the solenoid is in a de-energized state, and an armature attached to move with the pin, and being movable within the flux ring, but being separated from the flux ring by a sliding air gap.

3. The fuel injector of claim 2 wherein the core shield is composed of a single material that is homogenous except for a central hardened layer that is the armature stop, has lower magnetic properties than a remaining portion of the core shield, and occupies a minority of a volume of the core shield.

4. The fuel injector of claim 1 wherein the non-magnetic insert is also non-metallic.

5. The fuel injector of claim 2 wherein the fragile highly magnetic core is enclosed in a housing that includes the top piece;

the housing is received in a hollow segment of the injector body; and the flux ring is compressed between the housing and a portion of the injector body.

6. A fuel injector comprising:

an injector body defining a fuel inlet, a drain outlet and a nozzle outlet;

a direct operated check valve positioned in the injector body and including a needle valve member with an opening hydraulic surface exposed to fluid pressure in a nozzle supply passage, and a closing hydraulic surface exposed to fluid pressure in a needle control chamber, and the needle valve member being movable between a first position at which the nozzle supply passage is blocked to the nozzle outlet, and a second position at which the nozzle supply passage is open to the nozzle outlet;

a needle control valve positioned in the injector body and including a control valve member movable between a first position at which the needle control chamber is fluidly connected to the drain outlet, and a second position at which the needle control chamber is fluidly blocked to the drain outlet; and a solenoid actuator positioned in the injector body and including a stator assembly and an armature assembly coupled to the control valve member, the stator assembly including a top piece that defines a pin bore, a fragile highly magnetic core extending between a top end adjacent the top piece and an armature end, a centerpiece extending completely through the fragile highly magnetic core and having a first end received in the pin bore and a second end defining a core shield disposed between the fragile highly magnetic core and the armature assembly, the core shield being composed of a single material that is homogenous except for a central hardened layer that is the armature stop, has lower magnetic properties than a remaining portion of the core shield, and occupies a minority of a volume of the core shield, and the armature assembly including a nonmagnetic insert configured to contact the centerpiece when the solenoid actuator is in an energized state and out of contact with the centerpiece when the solenoid actuator is in a de-energized state.

7. The fuel injector of claim 6 wherein the stator assembly further includes:

a coil winding positioned around the fragile highly magnetic core;

an armature stop included in the core shield; and a flux ring defining a guide bore.

8. The fuel injector of claim 7 wherein the armature assembly further includes:

a pin in guide contact with the guide bore, and being movable between an energized position, being defined when the solenoid is in an energized state, and a de-energized position, being defined when the solenoid is in a de-energized state; and an armature attached to move with the pin, and being movable within the flux ring, but being separated from the flux ring by a sliding air gap;

wherein the nonmagnetic insert is mounted to at least one of the armature and the pin.

9. The fuel injector of claim 6 wherein the non-magnetic insert is also non-metallic.

10. The fuel injector of claim 7 wherein the fragile highly magnetic core is enclosed in a housing that includes the top piece;

the housing is received in a hollow segment of the injector body; and the flux ring is compressed between the housing and a portion of the injector body.

11. A fuel injector comprising:

an injector body defining a fuel inlet, a drain outlet and a nozzle outlet;

a direct operated check valve positioned in the injector body and including a needle valve member with an opening hydraulic surface exposed to fluid pressure in a nozzle supply passage, and a closing hydraulic surface exposed to fluid pressure in a needle control chamber, and the needle valve member being movable between a first position at which the nozzle supply passage is blocked to the nozzle outlet, and a second position at which the nozzle supply passage is open to the nozzle outlet;

a needle control valve positioned in the injector body and including a control valve member movable between a first position at which the needle control chamber is fluidly connected to the drain outlet, and a second position at which the needle control chamber is fluidly blocked to the drain outlet; and a solenoid actuator positioned in the injector body and including a stator assembly and an armature assembly coupled to the control valve member, the stator assembly including a top piece that defines a pin bore, a fragile highly magnetic core extending between a top end adjacent the top piece and an armature end, and a centerpiece extending completely through the fragile highly magnetic core, the centerpiece including a nonmagnetic insert having a first end received in the pin bore, the centerpiece including a second end defining a core shield disposed between the fragile highly magnetic core and the armature assembly, wherein the non-magnetic insert is mounted through the core shield, and wherein the nonmagnetic insert is configured to contact the armature assembly when the solenoid actuator is in an energized state and to be out of contact with the armature assembly when the solenoid actuator is in a de-energized state.

12. The fuel injector of claim 11 wherein:

the stator assembly further includes a coil winding positioned around the fragile highly magnetic core, and a flux ring defining a guide bore; and the armature assembly further includes a pin in guide contact with the guide bore, and being movable between an energized position, being defined when the solenoid is in an energized state, and a de-energized position, being defined when the solenoid is in a de-energized state, and an armature attached to move with the pin, and being movable within the flux ring, but being separated from the flux ring by a sliding air gap.

13. The fuel injector of claim 12 wherein:

the fragile highly magnetic core is enclosed in a housing that includes the top piece;

the housing is received in a hollow segment of the injector body; and the flux ring is compressed between the housing and a portion of the injector body.

14. The fuel injector of claim 11 wherein the non-magnetic insert is also non-metallic.

* * * * *